US010267097B2

(12) United States Patent
Mendez et al.

(10) Patent No.: US 10,267,097 B2
(45) Date of Patent: Apr. 23, 2019

(54) PRESSURE COMPENSATING CONNECTOR SYSTEM, DOWNHOLE ASSEMBLY, AND METHOD

(71) Applicants: Luis Mendez, Houston, TX (US); Marc Samuelson, Houston, TX (US); Travis Hall, Cypress, TX (US); Scott Christopher, Houston, TX (US); Shane Harris, Tomball, TX (US)

(72) Inventors: Luis Mendez, Houston, TX (US); Marc Samuelson, Houston, TX (US); Travis Hall, Cypress, TX (US); Scott Christopher, Houston, TX (US); Shane Harris, Tomball, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 150 days.

(21) Appl. No.: 15/347,508

(22) Filed: Nov. 9, 2016

(65) Prior Publication Data

US 2018/0128057 A1 May 10, 2018

(51) Int. Cl.

| | |
|---|---|
| ***E21B 17/02*** | (2006.01) |
| ***E21B 33/12*** | (2006.01) |
| ***H01R 13/523*** | (2006.01) |

(52) U.S. Cl.

CPC ..... *E21B 17/028* (2013.01); *E21B 33/12* (2013.01); *H01R 13/523* (2013.01)

(58) Field of Classification Search

CPC ..... E21B 17/028

See application file for complete search history.

(56) References Cited

U.S. PATENT DOCUMENTS 4,400,141 A * 8/1983 Lee ..... F04B 47/04 417/360

4,723,230 A * 2/1988 Chelminski ..... E21B 17/028 181/110

(Continued)

FOREIGN PATENT DOCUMENTS

WO 2016090003 A1 6/2016

OTHER PUBLICATIONS

"First Successful Deployment of Integrated Sand Control Packer and Fiber-Optic Wet Connector System", Bakerhughes.com, 2014, 2 pages.

(Continued)

*Primary Examiner* — Shane Bomar

(74) *Attorney, Agent, or Firm* — Cantor Colburn LLP

(57) ABSTRACT

A connector system including a first connector configured to electrically and/or optically connect to a second connector. The first connector includes a first connector body configured to engage with the second connector; a first housing remotely located from the first connector body; a first connecting line including at least one of an electrical control line and an optical fiber connecting the first housing to the first connector body; a first main control line including at least one of an electrical control line and an optical fiber connected to the first housing; and, a first pressure isolator associated with the first housing, the first pressure isolator isolating pressure within the first main control line from pressure within the first connecting line and the first connector body. The first housing and the first connecting line are interposed between the first main control line and the first connector body.

20 Claims, 3 Drawing Sheets

(56) References Cited

U.S. PATENT DOCUMENTS 6,158,532 A * 12/2000 Logan ..... E21B 17/003 175/320
6,420,976 B1 * 7/2002 Baggs ..... E21B 33/0355 166/250.15
6,755,253 B2 6/2004 Smith et al.
7,607,477 B2 10/2009 Stoesz et al.
7,628,543 B2 12/2009 Coronado
8,459,700 B2 6/2013 Gill et al.
8,602,658 B2 12/2013 Hopmann et al.
8,668,229 B2 3/2014 Stoesz et al.
9,157,561 B2 10/2015 Martin et al.
9,556,686 B1 * 1/2017 Krumpe ..... H01R 13/523
2005/0281511 A1 12/2005 Ringgenberg et al.
2007/0144746 A1 * 6/2007 Jonas ..... E21B 17/028 166/380
2008/0029274 A1 2/2008 Rytlewski et al.
2008/0236893 A1 * 10/2008 Peter ..... E21B 29/005 175/57
2010/0018701 A1 * 1/2010 Peter ..... E21B 44/00 166/250.01
2011/0191031 A1 8/2011 Harman et al.
2011/0277545 A1 * 11/2011 Ratcliffe ..... E21B 47/0006 73/152.51
2013/0056195 A1 * 3/2013 Sihler ..... H01R 39/643 166/65.1
2014/0335712 A1 11/2014 Semple et al.
2015/0021097 A1 * 1/2015 Wesemeier ..... E21B 25/08 175/59
2015/0129240 A1 5/2015 Bishop et al.
2017/0187177 A1 * 6/2017 Mangum ..... F04D 13/10
2017/0357051 A1 * 12/2017 Bulu ..... G02B 6/3816
2018/0094497 A1 * 4/2018 Carlsen ..... E21B 33/076

OTHER PUBLICATIONS

International Search Report for International Application No. PCT/US2017/055537; dated Jan. 17, 2018; 4 pages.
Written Opinion of the International Search Report for International Application No. PCT/US2017/055537; dated Jan. 17, 2018; 5 pages.

* cited by examiner

PRESSURE COMPENSATING CONNECTOR SYSTEM, DOWNHOLE ASSEMBLY, AND METHOD

BACKGROUND

In the drilling and completion industry, the formation of boreholes for the purpose of production or injection of fluid is common. The boreholes are used for exploration or extraction of natural resources such as hydrocarbons, oil, gas, water, and alternatively for CO2 sequestration.

Control of tools in the downhole environment and transmission of information between different points is an important facet of modern wells. Methods and apparatus capable of enhancing the quality of such communications have historically included hydraulic lines. More recently, electric conductors have been employed and most recently the industry has worked to create optical fiber assemblies capable of withstanding the harsh downhole environment in order to take advantage of the speed and accuracy of communications with optical fibers.

Deploying fiber optics in the lower completion depends on fiber optic connectors. Pressure compensating connectors exist for connecting optical fiber and electrical wire. These connectors are used for making and breaking connections in environments that have significantly different pressure than an ambient pressure where the connectors are assembled. Currently a downhole connector has all features integrated within the body of the connector. The pressure compensating features currently available are complicated devices prone to damage during their manufacture and their compensating ranges may be limited.

The art would be receptive to improvements in connectors for connecting optical fibers and electrical wire.

BRIEF DESCRIPTION

A connector system including a first connector configured to electrically and/or optically connect to a second connector. The first connector includes a first connector body configured to engage with the second connector; a first housing remotely located from the first connector body; a first connecting line including at least one of an electrical control line and an optical fiber connecting the first housing to the first connector body; a first main control line including at least one of an electrical control line and an optical fiber connected to the first housing; and, a first pressure isolator associated with the first housing, the first pressure isolator isolating pressure within the first main control line from pressure within the first connecting line and the first connector body. The first housing and the first connecting line are interposed between the first main control line and the first connector body.

A downhole assembly including: a lower completion having an uphole end portion; an upper completion having a downhole end portion; and, a connector system including: a first connector attached to the downhole end portion of the upper completion and a second connector attached to the uphole end portion of the lower completion, the first connector configured to electrically and/or optically connect to the second connector, the first connector including: a first connector body configured to engage with the second connector; a first housing remotely located from the first connector body; a first connecting line including at least one of an electrical control line and an optical fiber connecting the first housing to the first connector body; a first main control line including at least one of an electrical control line and an optical fiber connected to the first housing; and, a first pressure isolator associated with the first housing, the first pressure isolator isolating pressure within the first main control line from pressure within the first connecting line and the first connector body; wherein the first housing and the first connecting line are interposed between the first main control line and the first connector body.

A method of compensating and isolating pressure in a connector system for a downhole assembly, the connector system including a first connector and a second connector, the method including: running a lower completion into a borehole, the lower completion including the second connector; subsequently running an upper completion into the borehole, the upper completion including the first connector; electrically and/or optically connecting a first connector body of the first connector with a second connector body of the second connector; compensating pressure in the first connector at a first housing located remotely from the first connector body at a location uphole of the first connector body, and compensating pressure in the second connector at a second housing located remotely from the second connector body at a location downhole of the second connector body, the first and second housings connected to the first and second connector bodies by first and second connecting lines, respectively; and, isolating pressure in the first connector body and the first connecting line from pressure within a first main control line at the first housing, and isolating pressure in the second connector body and the second connecting line from pressure within a second main control line at the second housing.

A connector system including: a first connector configured to electrically and/or optically connect to a second connector, the first connector including: a first connector body configured to engage with the second connector; a first housing remotely located from the first connector body; a first pressure compensation device associated with the first housing; a first connecting line including at least one of an electrical control line and an optical fiber connecting the first housing to the first connector body; and, a first main control line including at least one of an electrical control line and an optical fiber connected to the first housing; wherein the first housing and the first connecting line are interposed between the first main control line and the first connector body.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
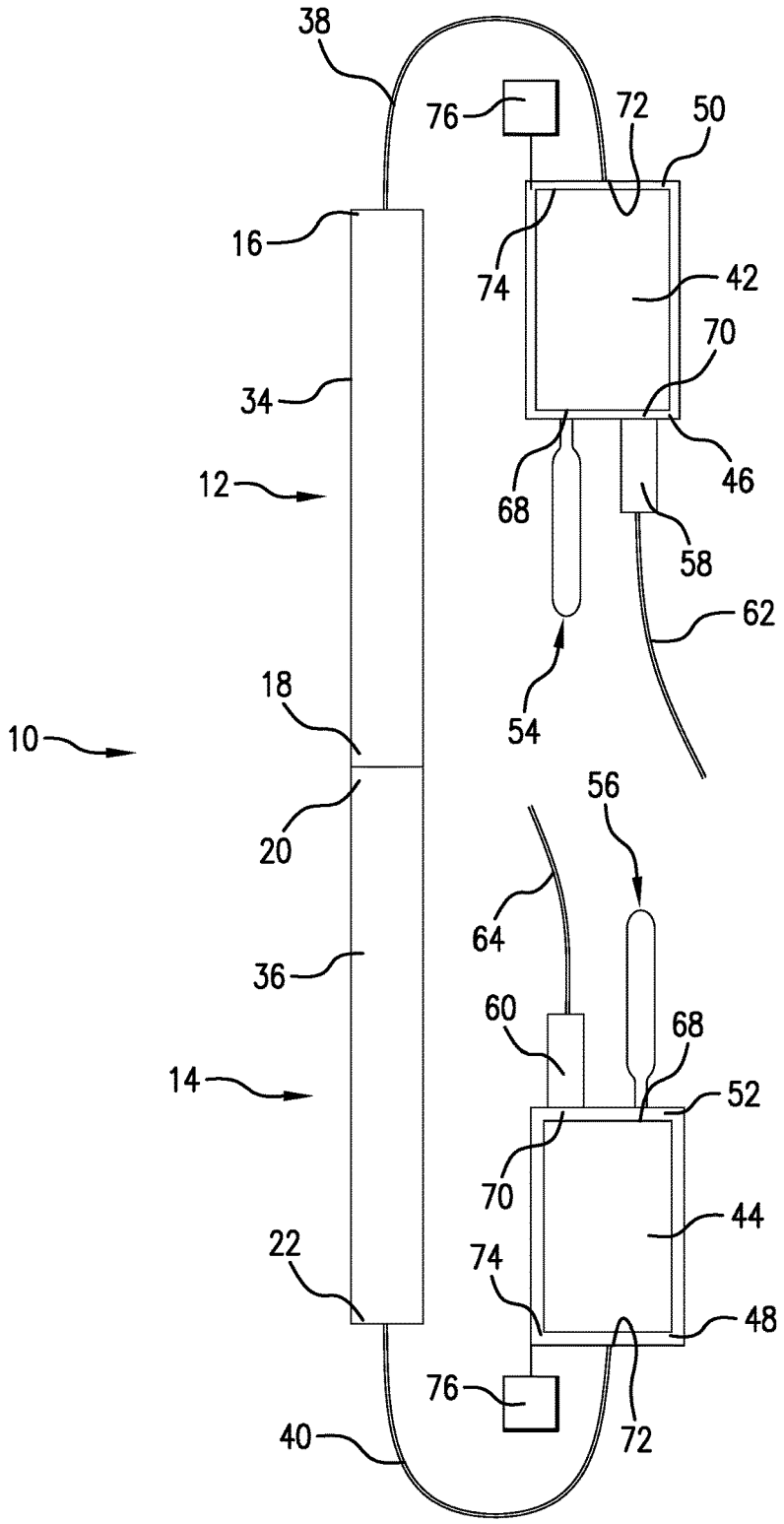
FIG. 1 depicts a schematic view of an embodiment of a connector system.

Referring to FIG. 1, an embodiment of a pressure compensating connector system 10 is shown. The connector system 10 includes a first connector 12 connectable to a second connector 14. The first connector 12 may be an upper wet connect, and the second connector 14 may be a lower wet connect. The second connector 14, such as, but not limited to a male (or female) half of the connector system 10, may be positioned downhole with a lower completion. Then, the first connector 12, such as, but not limited to a female (or male) half of the connector system 10, may be run in with an upper completion to connect with the second connector 14. It should be understood that the first and second connectors 12, 14 may be either male or female, depending on how they are run, such as with respect to an associated downhole assembly. Further, the first connector 12 may be used as a lower wet connect and the second connector 14 may be used as an upper wet connect. Also, connection between the first and second connectors 12, 14 may include alternate connection arrangements.

With further reference to FIG. 1, the first connector 12 includes a first connector body 34 and the second connector 14 includes a second connector body 36. The first connector body 34 includes a first end 16 and a second end 18, and the second connector body 36 includes a first end 20 and a second end 22. In the embodiment where the first and second connectors 12, 14 are upper and lower wet connects, the first ends 16, 20 of each of the first and second connector bodies 34, 36 are uphole ends and the second ends 18, 22 of each of the first and second connector bodies 34, 36 are downhole ends, such that the second end 18 of the first connector 12 is connected to the first end 20 of the second connector 14. Extending from the first end 16 of the first connector body 34 is a first connecting line 38 containing optical fiber and/or electric control line, and extending from the second end 22 of the second connector body 36 is a second connecting line 40 containing optical fiber and/or electric control line. The connector system 10 can be electric or fiber optic or a hybrid with both. While the first and second connecting lines (cables) 38, 40 may have any length suitable for a particular configuration and downhole system, in one non-limiting embodiment, the first and second connecting lines 38, 40 may be a plurality of meters in length. When the first connector 12 and second connector 14 are connected, the first and second connecting lines 38, 40 are optically and/or electrically connected to each other, and when the first connector 12 and second connector 14 are separated, the first and second connecting lines 38, 40 are optically and/or electrically disconnected from each other. Pressure fittings may be provided at each end of the first and second connecting lines 38, 40, although the pressure differential across these areas will be substantially zero.

First and second pressure housings 42, 44 are connected to the first and second connector bodies 34, 36 by the first and second connecting lines 38, 40. The housings 42, 44 are packaged separate from the connector bodies 34, 36 altogether, thus provided in a location remote from the connector bodies 34, 36. The housings 42, 44 have a first end 46, 48, such as an uphole end, and a second end 50, 52, such as a downhole end. The first and second housings 42, 44 are associated with first and second pressure compensators 54, 56, which may be housed internally within the housings 42, 44 or mounted externally to the housings 42, 44. In the illustrated embodiment, the first pressure compensator 54 is connected to the first end 46 of the first housing 42, and the second pressure compensator 56 is connected to the second end 52 of the second housing 44, however the pressure compensators 54, 56 may be connected at alternate locations to their respective housings 42, 44. The pressure compensators 54, 56, may, in one embodiment, be provided as bellows, such as metal bellows, which are more effective than elastomer bladders in high temperature environments. Alternatively, depending on intended use, the pressure compensators 54, 56 may include rubber bellows. Further, since the pressure compensators 54, 56 are not packaged within the connector bodies 34, 36, there is less of a size restriction to the pressure compensators 54, 56, and pressure compensators 54, 56 of varying sizes, structures, and materials may be utilized depending on the intended environment.

Further associated with the first and second housings 42, 44 are first and second pressure isolators 58, 60. The pressure isolators 58, 60 isolate pressure between the connecting lines 38, 40 and first and second main control lines (cables) 62, 64, which may include fiber optic and/or electric control lines. The first main control line 62 connects the first end 46 of the first housing 42 to an uphole location, such as a surface location. The second main control line 64 extends from the second end 52 of the second housing 44 to a downhole location, such as to a downhole tool or sensor, or all the way to the bottom of a lower completion which could be thousands of meters below the second connector body 36. The first and second pressure isolators 58, 60, such as, but not limited to pressure fittings or seals, may be provided exteriorly or interiorly of the housings 42, 44. In one embodiment of use of the illustrated connector system 10 downhole, pressure within the main control lines 62, 64 will be atmospheric pressure, while pressure in the connector bodies 34, 36, connecting lines 38, 40, and pressure compensation housings 42, 44 will be hydrostatic pressure, that is, equalized to the downhole ambient pressure. At the second end 18 of the first connector body 34 and the first end 20 of the second connector body 36 are balanced pressures, so that the pressure in the connector bodies 34, 36 are balanced and will respond to whatever the downhole pressure is and will equalize. Thus, the pressure isolators 58, 60 will isolate the atmospheric pressure in the main control lines 62, 64 from the hydrostatic pressure in the connector bodies 34, 36. In other words, the first and second connector bodies 34, 36, and the first and second connecting lines 38, 40, may be at a first pressure, and the first and second main control lines 62, 64 may be at a second pressure, different than the first pressure, and the first pressure is isolated from the second pressure by the first and second pressure isolators 58, 60.

Figure 2:
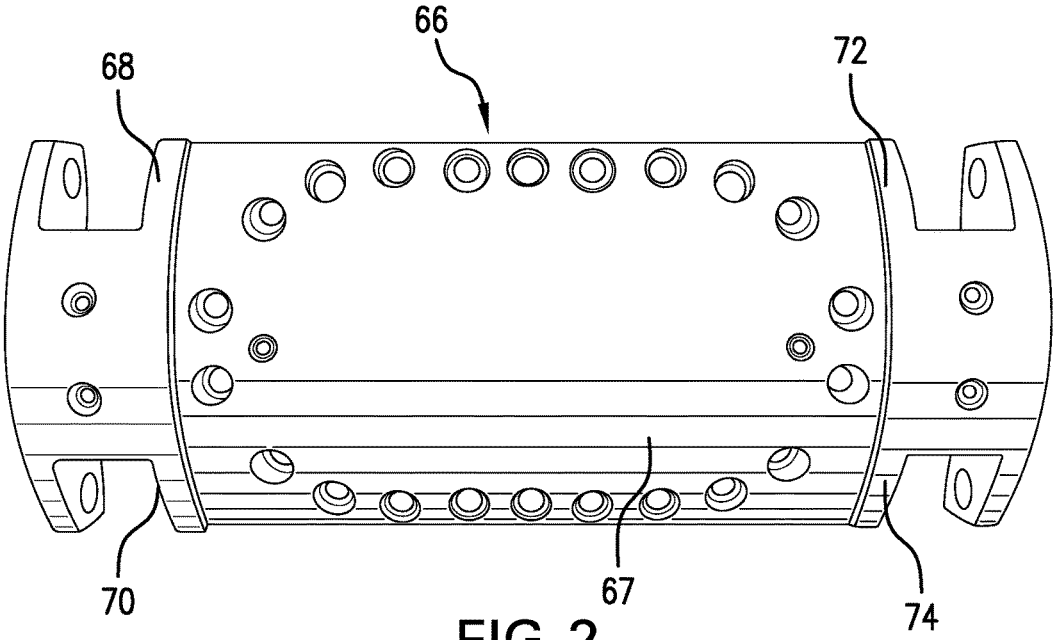
FIG. 2 depicts a plan view of one embodiment of a housing for the connector system of FIG. 1.
Figure 3:
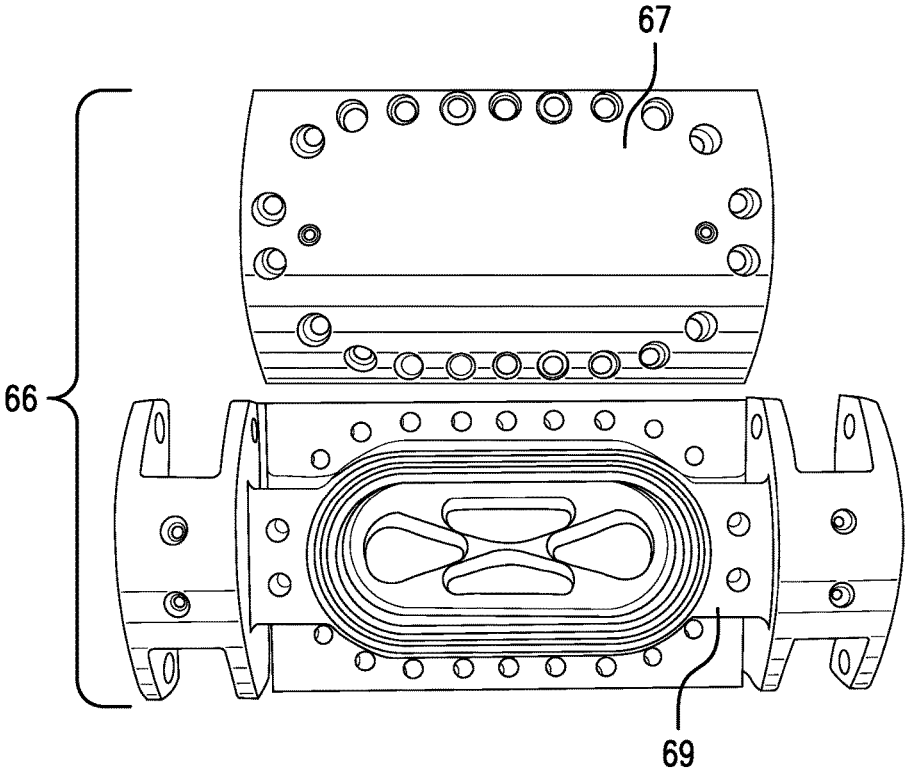
FIG. 3 depicts a plan view of the housing of FIG. 2 with a cover removed.

The housings 42, 44 are splice housings, such that the first and second connecting lines 38, 40 are spliced to the first and second main control lines 62, 64, respectively. One embodiment of a splice housing arrangement 66 is illustrated in FIGS. 2 and 3, with a cover 67 removed from a base 69 in FIG. 3. The splice housing arrangement 66 may provide four different connection points 68, 70, 72, 74, two on a first end and two on a second end, however the housing 66 may include more or less connection points, and not necessarily at the corners of the housing 66. The pressure compensators 54, 56 may be connected to a first connection point 68. The main control lines 62, 64 and first and second pressure isolators 58, 60 may be connected to a second connection point 70, while the connecting lines 38, 40 may be connected to a third connection point 72. The connecting lines 38, 40 and main control lines 62, 64 are spliced and handled within the housings 42, 44. If there is a fourth connection point 74, such as would be provided by the illustrated splice housing arrangement 66, the fourth connection point 74 could either be left unoccupied, or alternatively another device 76 could be connected to the fourth connection point 74, such as a control line (not shown) or a pressure gauge or sensor, such as an end of line pressure gauge.

Figure 4:
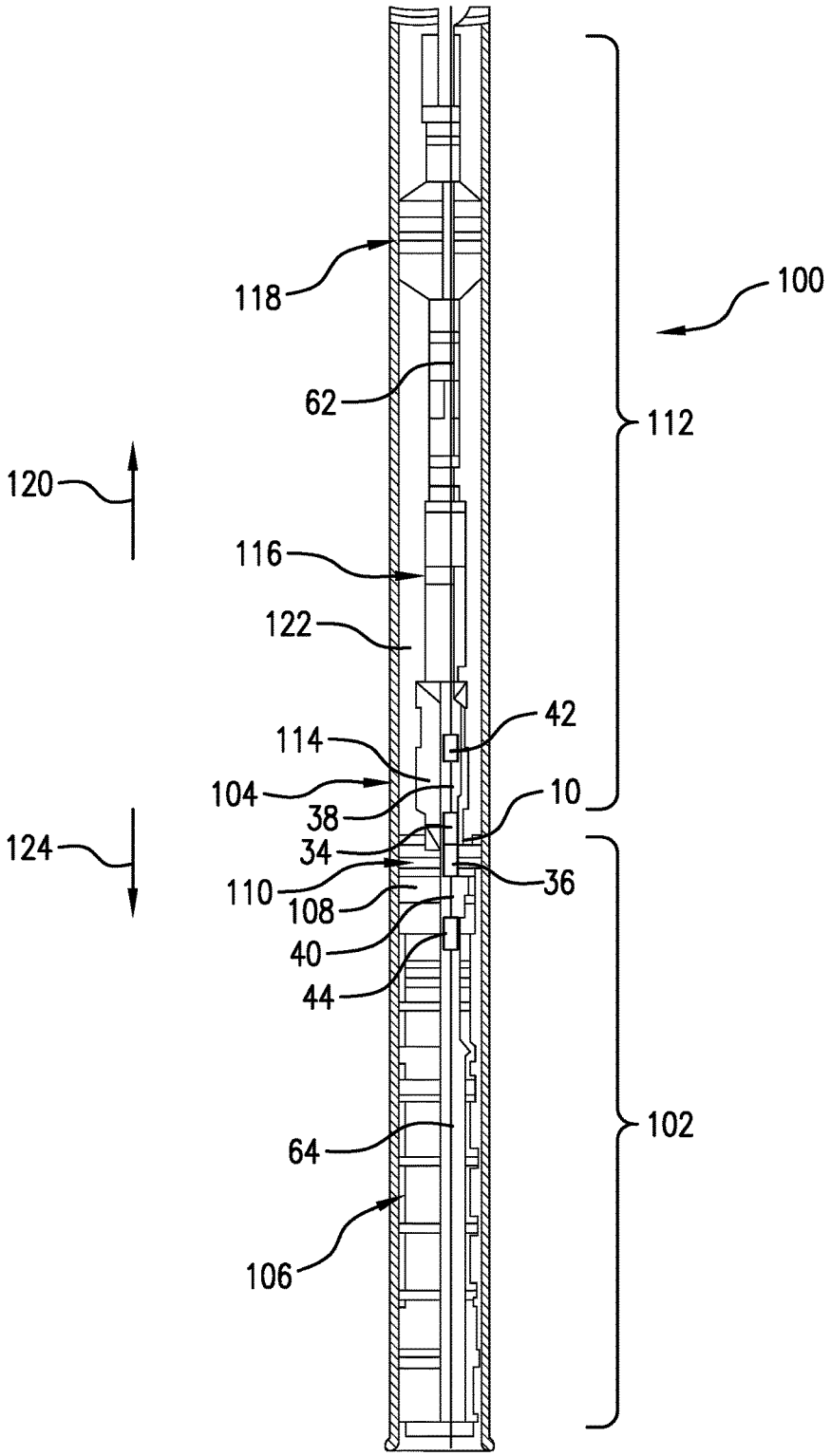
FIG. 4 depicts a schematic view of one embodiment of a downhole assembly using the connector system of FIG. 1.

FIG. 4 illustrates one embodiment of a downhole assembly 100 that incorporates the connector system 10. The illustrated embodiment of a completion is just one example, and the completion can be configured in numerous ways depending on requirements. For example, the downhole assembly 100 could be run into the borehole 104 with the first and second connectors 12, 14 connected, and then later the first connector 12 may be disconnected from the second connector 14. Then, subsequently, the first connector 12 of a different upper completion or the same upper completion may be connected, or re-connected, with the second connector 14. In another embodiment, the downhole assembly 100 may be a two-trip sand control completion system. In a first trip, the lower completion 102 is installed within a borehole 104. The lower completion 102 includes, in the illustrated embodiment, screens 106, a frac sleeve 108, and a sand control packer 110. The second connector body 36 is packaged within the sand control packer 110, at an uphole end of the lower completion 102. The second pressure compensation housing 44 may be packaged downhole of the sand control packer 110, and the second main control line 64 is secured longitudinally relative to the tubulars (such as the screens 106 and frac sleeve 108) that extend downhole of the sand control packer 110. Once the lower completion 102 is run into the borehole, the sand control packer 110 is set within the borehole 104 (or outer casing or other outer tubular). Some systems are two trip in which the sand control packer 110 is set with the lower completion 102, however in three trip systems the screens 106 are run in with the sand control packer 110 and set, and then a second trip is run with another packer and carrier system with the second connector 14 run and set. Then, the upper completion 112 is subsequently run downhole with the first connector 12 to connect with the second connector 14. In the illustrated embodiment, the upper completion 112 includes a reconnect tool 114, expansion joint 116, and production packer 118. The first connector 12 is installed within the upper completion 112, with the first connector body 34 in the reconnect tool 114, such that it is run into the borehole 104 and connects with the second connector body 36, and this connection occurs at a connection interface between the first and second connectors 12, 14 of the connector system 10. The first housing 42 is located uphole of the first connector body 34 and the first main control line 62 extends in an uphole direction 120 from the first housing 42. The second housing 44 is located downhole of the second connector body 36 and the second main control line 64 extends in a downhole direction 124 from the second housing 44. Both the first and second connectors 12, 14 can be exterior of the production tubing path, but also interior of an annulus 122. In other words, the first and second connectors 12, 14 may be protected from a potentially damaging production or injection flowpath, as well as the borehole environment. For example, portions of the first and second connectors 12, 14 may be built into the wall of the reconnect tool 114 or packer 110, respectively. While examples have been provided, the first and second connectors 12, 14 may be run into the borehole 104 and connected therein in alternate manners, depending on requirements, such as running the second connector 14 with the first connector 12 connected thereto.

Thus, the connector system 10 provides pressure compensation to equalize downhole pressure separate from the connector bodies 34, 36. Additionally, the system 10 separates (isolates) the pressure from the first and second main control lines 62, 64 that the connector bodies 34, 36 are connected to from the connector bodies 34, 36, which is contrary to conventional connector systems which incorporate pressure isolation and compensation within the connector bodies. Further, the pressure compensators 54, 56 of the connector system 10 are not unduly limited by the connector bodies 34, 36, such as the elastomer bladders used in conventional connector systems. As downhole assemblies are utilized in high temperature environments, the elastomer bladders may sometimes not be sufficient. Additional advantages are appreciated using the connector bodies 34, 36 without pressure compensation and isolators therein from a manufacturing standpoint, because different vendors can be used to manufacture each part of the connector system 10 without requiring excessive logistical efforts and transportation between the vendors, as opposed to manufacturing a connector system that has pressure isolation and compensation with the connector body itself. Thus, simplicity in manufacturing and reduction in damage can be appreciated using the design of the connector system 10.

Set forth below are some embodiments of the foregoing disclosure:

Embodiment 1: A connector system including a first connector configured to electrically and/or optically connect to a second connector. The first connector includes a first connector body configured to engage with the second connector; a first housing remotely located from the first connector body; a first connecting line including at least one of an electrical control line and an optical fiber connecting the first housing to the first connector body; a first main control line including at least one of an electrical control line and an optical fiber connected to the first housing; and, a first pressure isolator associated with the first housing, the first pressure isolator isolating pressure within the first main control line from pressure within the first connecting line and the first connector body. The first housing and the first connecting line are interposed between the first main control line and the first connector body.

Embodiment 2: The connector system of any of the preceding embodiments, further including the second connector, the second connector including: a second connector body engageable with the first connector body; a second housing remotely located from the second connector body; a second connecting line including at least one of an electrical control line and an optical fiber connecting the second housing to the second connector body; a second main control line including at least one of an electrical control line and an optical fiber connected to the second housing; and, a second pressure isolator associated with the second housing, the second pressure isolator isolating pressure within the second main control line from pressure within the second connecting line and the second connector body, wherein the second housing and the second connecting line are interposed between the second main control line and the second connector body.

Embodiment 3: The connector system of any of the preceding embodiments wherein the first pressure isolator is connected between the first housing and the first main control line.

Embodiment 4: The connector system of any of the preceding embodiments further including a first pressure compensator associated with the first housing.

Embodiment 5: The connector system of any of the preceding embodiments wherein the first pressure compensator includes one of bellows, a bladder, and a piston.

Embodiment 6: The connector system of any of the preceding embodiments wherein the first pressure compensator includes metal bellows.

Embodiment 7: The connector system of any of the preceding embodiments wherein the first pressure compensator is connected to the first housing, in fluidic communication with an interior of the first housing, and disposed exteriorly of the first housing.

Embodiment 8: The connector system of any of the preceding embodiments wherein the first connecting line is attached to a first end of the first housing, and the first main control line is attached to a second end of the first housing, the first end opposite the second end.

Embodiment 9: The connector system of any of the preceding embodiments, further including a first pressure compensator, wherein the first pressure compensator is attached to a first connection point of the first housing, the first main control line is attached to a second connection point of the first housing with the first pressure isolator, and the first connecting line is attached to a third connection point of the first housing.

Embodiment 10: The connector system of any of the preceding embodiments, further including a sensor attached to a fourth connection point of the first housing.

Embodiment 11: The connector system of any of the preceding embodiments, wherein pressure in the first main control line is isolated from pressure in the first housing by the first pressure isolator.

Embodiment 12: The pressure compensating connector system of any of the preceding embodiments, further including the second connector, wherein the first and second connectors are wet connects.

Embodiment 13: A downhole assembly including a lower completion having an uphole end portion; an upper completion having a downhole end portion; and, a connector system including: a first connector attached to the downhole end portion of the upper completion and a second connector attached to the uphole end portion of the lower completion, the first connector configured to electrically and/or optically connect to the second connector, the first connector including: a first connector body configured to engage with the second connector; a first housing remotely located from the first connector body; a first connecting line including at least one of an electrical control line and an optical fiber connecting the first housing to the first connector body; a first main control line including at least one of an electrical control line and an optical fiber connected to the first housing; and, a first pressure isolator associated with the first housing, the first pressure isolator isolating pressure within the first main control line from pressure within the first connecting line and the first connector body; wherein the first housing and the first connecting line are interposed between the first main control line and the first connector body.

Embodiment 14: The downhole assembly of any of the preceding embodiments, wherein the lower completion includes a packer and the upper completion includes a reconnect tool, the first connector attached to the reconnect tool and the second connector attached to the reconnect tool.

Embodiment 15: The downhole assembly of any of the preceding embodiments, wherein the second connector includes: a second connector body engageable with the first connector body; a second housing remotely located from the second connector body; a second connecting line including at least one of an electrical control line and an optical fiber connecting the second housing to the second connector body; a second main control line including at least one of an electrical control line and an optical fiber connected to the second housing; and, a second pressure isolator associated with the second housing, the second pressure isolator isolating pressure within the second main control line from pressure within the second connecting line and the second connector body; wherein the second housing and the second connecting line are interposed between the second main control line and the second connector body.

Embodiment 16: The downhole assembly of any of the preceding embodiments, wherein the first connector body is disposed downhole of the first connecting line and the first housing, and the first main control line extends in an uphole direction from the first housing, the second connector body is disposed uphole of the second connecting line and the second housing, and the second main control line extends in a downhole direction from the second housing.

Embodiment 17: A method of compensating and isolating pressure in a connector system for a downhole assembly, the connector system including a first connector and a second connector, the method including: running a lower completion into a borehole, the lower completion including the second connector; subsequently running an upper completion into the borehole, the upper completion including the first connector; electrically and/or optically connecting a first connector body of the first connector with a second connector body of the second connector; compensating pressure in the first connector at a first housing located remotely from the first connector body at a location uphole of the first connector body, and compensating pressure in the second connector at a second housing located remotely from the second connector body at a location downhole of the second connector body, the first and second housings connected to the first and second connector bodies by first and second connecting lines, respectively; and, isolating pressure in the first connector body and the first connecting line from pressure within a first main control line at the first housing, and isolating pressure in the second connector body and the second connecting line from pressure within a second main control line at the second housing.

Embodiment 18: The method of any of the preceding embodiments, wherein the lower completion includes a packer, the second connector connected to the packer, and further comprising setting the packer within the borehole prior to running the upper completion into the borehole.

Embodiment 19: The method of any of the preceding embodiments, wherein the first and second connector bodies have no pressure compensation or isolation features.

Embodiment 20: A connector system including a first connector configured to electrically and/or optically connect to a second connector, the first connector including: a first connector body configured to engage with the second connector; a first housing remotely located from the first connector body; a first pressure compensation device associated with the first housing; a first connecting line including at least one of an electrical control line and an optical fiber connecting the first housing to the first connector body; and, a first main control line including at least one of an electrical control line and an optical fiber connected to the first housing; wherein the first housing and the first connecting line are interposed between the first main control line and the first connector body.

The use of the terms "a" and "an" and "the" and similar referents in the context of describing the invention (especially in the context of the following claims) are to be construed to cover both the singular and the plural, unless otherwise indicated herein or clearly contradicted by context. Further, it should further be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A connector system comprising:

a first connector configured to electrically and/or optically connect to a second connector, the first connector including:

a first connector body configured to engage with the second connector;

a first housing remotely located from the first connector body;

a first pressure compensator attached to a first connection point of the first housing;

a first connecting line including at least one of an electrical control line and an optical fiber connecting the first housing to the first connector body;

a first main control line including at least one of an electrical control line and an optical fiber connected to the first housing; and, a first pressure isolator associated with the first housing, the first pressure isolator isolating pressure within the first main control line from pressure within the first connecting line and the first connector body, the first main control line attached to a second connection point of the first housing with the first pressure isolator;

wherein the first housing and the first connecting line are interposed between the first main control line and the first connector body, and the first connecting line is attached to a third connection point of the first housing.

2. The connector system of claim 1 further comprising the second connector, the second connector including:

a second connector body engageable with the first connector body;

a second housing remotely located from the second connector body;

a second connecting line including at least one of an electrical control line and an optical fiber connecting the second housing to the second connector body;

a second main control line including at least one of an electrical control line and an optical fiber connected to the second housing; and, a second pressure isolator associated with the second housing, the second pressure isolator isolating pressure within the second main control line from pressure within the second connecting line and the second connector body;

wherein the second housing and the second connecting line are interposed between the second main control line and the second connector body.

3. The connector system of claim 1 wherein the first pressure isolator is connected between the first housing and the first main control line.

4. The connector system of claim 1 wherein the first pressure compensator includes one of bellows, a bladder, and a piston.

5. The connector system of claim 4 wherein the pressure compensator includes metal bellows.

6. The connector system of claim 1 wherein the first pressure compensator is in fluidic communication with an interior of the first housing, and disposed exteriorly of the first housing.

7. The connector system of claim 1 wherein the first connecting line is attached to a first end of the first housing, and the first main control line is attached to a second end of the first housing, the first end opposite the second end.

8. The connector system of claim 1, further comprising a sensor attached to a fourth connection point of the first housing.

9. The connector system of claim 1, wherein pressure in the first main control line is isolated from pressure in the first housing by the first pressure isolator.

10. The connector system of claim 1, further comprising the second connector, wherein the first and second connectors are wet connects.

11. A downhole assembly comprising:

a lower completion having an uphole end portion;

an upper completion having a downhole end portion; and, a connector system including:

a first connector attached to the downhole end portion of the upper completion and a second connector attached to the uphole end portion of the lower completion, the first connector configured to electrically and/or optically connect to the second connector, the first connector including:

a first connector body configured to engage with the second connector;

a first housing remotely located from the first connector body;

a first pressure compensator attached to a first connection point of the first housing;

a first connecting line including at least one of an electrical control line and an optical fiber connecting the first housing to the first connector body;

a first main control line including at least one of an electrical control line and an optical fiber connected to the first housing; and, a first pressure isolator associated with the first housing, the first pressure isolator isolating pressure within the first main control line from pressure within the first connecting line and the first connector body, the first main control line attached to a second connection point of the first housing with the first pressure isolator;

wherein the first housing and the first connecting line are interposed between the first main control line and the first connector body, and the first connecting line is attached to a third connection point of the first housing.

12. The downhole assembly of claim 11, wherein the lower completion includes a packer and the upper completion includes a reconnect tool, the first connector attached to the reconnect tool and the second connector attached to the reconnect tool.

13. The downhole assembly of claim 11, wherein the second connector includes:

a second connector body engageable with the first connector body;

a second housing remotely located from the second connector body;

a second connecting line including at least one of an electrical control line and an optical fiber connecting the second housing to the second connector body;

a second main control line including at least one of an electrical control line and an optical fiber connected to the second housing; and, a second pressure isolator associated with the second housing, the second pressure isolator isolating pressure within the second main control line from pressure within the second connecting line and the second connector body;

wherein the second housing and the second connecting line are interposed between the second main control line and the second connector body.

14. The downhole assembly of claim 13, wherein the first connector body is disposed downhole of the first connecting line and the first housing, and the first main control line extends in an uphole direction from the first housing, the second connector body is disposed uphole of the second connecting line and the second housing, and the second main control line extends in a downhole direction from the second housing.

15. A method of compensating and isolating pressure in the connector system of the downhole assembly of claim 13, the method comprising:

running the lower completion into a borehole, the lower completion including the second connector;

running the upper completion into the borehole, the upper completion including the first connector;

electrically and/or optically connecting the first connector body of the first connector with the second connector body of the second connector;

compensating pressure in the first connector at the first housing located remotely from the first connector body at a location uphole of the first connector body, and compensating pressure in the second connector at the second housing located remotely from the second connector body at a location downhole of the second connector body; and, isolating pressure in the first connector body and the first connecting line from pressure within the first main control line at the first housing, and isolating pressure in the second connector body and the second connecting line from pressure within the second main control line at the second housing.

16. The method of claim 15, wherein the lower completion includes a packer, the second connector connected to the packer, and further comprising setting the packer within the borehole prior to running the upper completion into the borehole.

17. The method of claim 15, wherein the first and second connector bodies have no pressure compensation or isolation features.

18. A connector system comprising:

a first connector configured to electrically and/or optically connect to a second connector, the first connector including:

a first connector body configured to engage with the second connector;

a first housing remotely located from the first connector body;

a first pressure compensation device associated with the first housing and attached to a first connection point of the first housing;

a first connecting line including at least one of an electrical control line and an optical fiber connecting the first housing to the first connector body; and, a first main control line including at least one of an electrical control line and an optical fiber connected to the first housing, the first main control line attached to a second connection point of the first housing with a first pressure isolator;

wherein the first housing and the first connecting line are interposed between the first main control line and the first connector body, and the first connecting line is attached to a third connection point of the first housing.

19. A connector system comprising:

a first connector configured to electrically and/or optically connect to a second connector, the first connector including:

a connector body configured to engage with the second connector;

a connecting line extending from the connector body;

a main control line; and, a housing remotely located from the connector body, the housing having a first connection point, a second connection point, and a third connection point, the first connection point configured to attach a pressure compensator thereto, the main control line attached to the second connection point with a pressure isolator thereto, and the connecting line attached to the third connection point.

20. The connector system of claim 19, further comprising the pressure compensator.

* * * * *